United States Patent [19]

Orth

[11] 3,991,493

[45] Nov. 16, 1976

[54] FLOOR STRUCTURE FOR EARTHMOVING SCRAPER

[75] Inventor: Edward G. Orth, Peoria, Ill.

[73] Assignee: Westinghouse Air Brake Company, Pittsburgh, Pa.

[22] Filed: Sept. 8, 1975

[21] Appl. No.: 611,506

[52] U.S. Cl. ..... 37/7; 37/126 AE; 214/83.34; 214/510

[51] Int. Cl.[2] ..... B60P 1/36

[58] Field of Search..... 37/7, 8, 124, 126 R, 37/126 A, 126 AC, 126 AE, 129; 214/44 B, 508–510, 514, 83.26, 83.34, 83.36, 518; 198/109, 113

[56] References Cited

UNITED STATES PATENTS

| | | | |
|---|---|---|---|
| 707,503 | 8/1902 | Deering | 214/83.34 X |
| 1,530,779 | 3/1925 | Le Tourneau | 37/126 AC |
| 2,119,424 | 5/1938 | Douglas et al. | 214/83.34 X |
| 2,140,974 | 12/1938 | Wagner et al. | 214/83.34 X |
| 3,035,724 | 5/1962 | Clark et al. | 214/510 X |
| 3,187,915 | 6/1965 | Spalding | 37/7 X |
| 3,240,370 | 3/1966 | Sadler | 214/83.34 X |
| 3,486,251 | 12/1969 | Carston | 37/129 X |
| 3,675,347 | 7/1972 | Siewert et al. | 37/126 AE X |
| 3,904,049 | 9/1975 | Prahst | 214/83.34 |

FOREIGN PATENTS OR APPLICATIONS

| | | | |
|---|---|---|---|
| 674,121 | 6/1952 | United Kingdom | 214/83.34 |

*Primary Examiner*—E. H. Eickholt

*Attorney, Agent, or Firm*—Leydig, Voit, Osann, Mayer & Holt, Ltd.

[57] ABSTRACT

A scraper for earth moving purposes including an open-fronted bowl formed of a pair of laterally spaced vertical side sheets having a fixed floor section at the rear thereof, and a blade base at the front, defining a discharge opening between them. A rolling frame supported by guide tracks normally closes off the discharge opening. A substantially continuous flexible floor structure overlies the rolling frame to support the soil in the bowl. The floor structure is made up of a set of articulated strips supported on a roller train, with the leading end of the roller train passing around the front end of the rolling frame through 180° so that when the leading end is pulled by an actuator the rolling frame is retracted to uncover the discharge opening. In the preferred embodiment an ejector plate is connected to the trailing end of the roller train so that continued movement of the roller train causes the ejector plate to conduct the soil from the back of the bowl for discharge into the opening.

17 Claims, 12 Drawing Figures

FLOOR STRUCTURE FOR EARTHMOVING SCRAPER

BACKGROUND OF THE INVENTION

The invention relates generally to earth moving devices in the form of a tractor drawn scraper bowl having improved means for dumping the soil when the scraper bowl is filled.

When operating under wet conditions, or in clayey soils, the soil collected in a scraper bowl is not easily dislodged. It has been a practice in the past to provide a rearwardly sliding floor section to uncover a front discharge opening and to provide an ejector plate to push the soil from the back of the bowl forwardly through the opening. Because of the pressing weight of the soil and the resistance of the soil to shearing action, large actuators must be employed for shifting a conventional movable floor section to create the opening and in subsequently shoving the soil along a fixed floor section for discharge through the opening. Indeed, the effect of the ejector plate is often to compact the soil into a tight mass which becomes firmly stuck to the floor of the bowl and to the bowl side sheets to produce a bracing reaction which may be sufficiently strong as to block the ejector plate against further forward movement. The scraper must be then shut down for cleaning, and it is sometimes necessary to suspend all scraping operations until the soil is more dry and friable. Such lost time is costly to the contractor.

It is, accordingly, an object of the present invention to provide a scraper bowl with a "rolling bottom", that is, a floor which may be simply "rolled" out of the way without shearing action to form a discharge opening, a floor which moves with the ejector plate, so that the soil is, in effect, transported on roller bearings from the back to the front of the bowl.

It is a more specific object of the invention to provide, in a scraper bowl, a floor in the form of a series of transversely extending strips which are articulated with respect to one another and which are supported upon an anti-friction roller train.

It is a general object to provide floor structure for both creating an opening at the front of the bowl and for transporting soil from the back of the bowl which is capable of operation using actuators requiring only a fraction of the power usually required for shifting a conventional floor section or shifting a conventional type of ejector plate, particularly under conditions when the soil is wet or clayey.

It is another object to provide an improved floor structure for a scraper bowl which enables increased promptness of discharge under both normal and difficult soil conditions permitting the scraper to make a greater number of round trips per unit of time, thereby bringing about a substantial improvement in scraping efficiency while decreasing the energy consumed per trip.

Other objects and advantages of the invention will become apparent upon reading the attached detailed description and upon reference to the drawings.

Figures 1, 2, 2A:
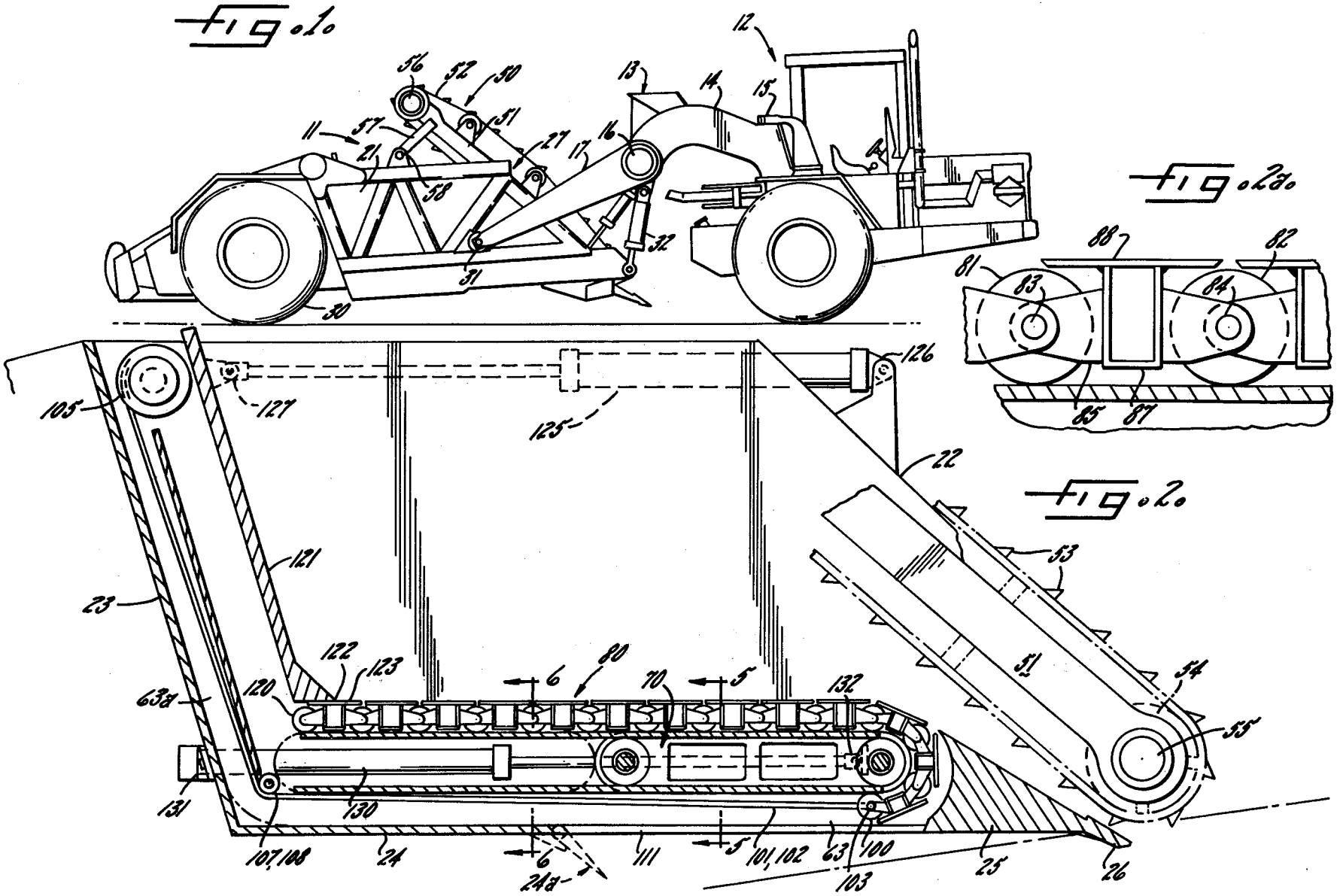
FIG. 1 is a side elevation of a complete scraper assembly, including tractor, to which the present invention has been applied.
FIG. 2 is a longitudinal cross section, taken vertically through a bowl constructed in accordance with the invention, with certain parts shown fragmentarily.
FIG. 2*a* is an enlarged end view of an articulated floor section.

While the invention has been described in connection with a preferred embodiment, it will be understood that I do not intend to be limited to the illustrated embodiment but intend, on the contrary, to cover the various alternative and equivalent forms of the invention included within the spirit and scope of the appended claims.

DETAILED DESCRIPTION OF THE PREFERRED EMBODIMENT

Referring now to the drawings, there is disclosed a scraper assembly having a bowl 11 and a tractor 12 interconnected by a draft frame 13. The draft frame includes a so-called goose-neck 14 which is of rigid construction pivoted to the tractor at 15 for horizontal swinging movement and carrying a torque tube 16, to the lateral ends of which are rigidly secured a pair of draft members 17.

The bowl 11 has side sheets 21 and 22 which are spanned by a back wall 23 and fixed floor section 24. At the front the side sheets are bridged by a blade base 25 which mounts a cutter blade 26. The bowl has an open front 27 occupied by an elevator to which reference will be made.

The rear end of the bowl structure is supported upon rubber tired wheels 30, while the forward portion of the bowl is supported by pivotal engagement, at 31, with the rear ends of the draft members 17. The running level of the blade is controlled by a pair of actuators 32 which are interconnected between the ends of the torque tube and the front corners of the bowl. By extending the actuators the bowl is rocked clockwise, thereby lowering the scraper blade 26 to a predetermined depth of cut.

Mounted transversely at the open front end of the bowl is an elevator 50 formed of a pair of spaced frame members 51 occupying a rearwardly inclined position. Extending between the members is a drive shaft (not shown) having sprockets mounting a pair of chains 52 carrying transversely extending flights 53, the chains being trained about idler rollers 54 mounted upon a shaft 54 at the lower end of the elevator. The shaft at the upper end of the elevator is driven by a motor 56. For supporting the frame members 51 respective brackets 57 are provided, pivoted at 58 so that the elevator may swing upwardly to accommodate any obstructions on the ground engaged by the blade. It is apparent that as the drive motor is rotated, the underside of the elevator engages the soil which has been scalped and loosened by the blade 25, propelling it back into the bowl.

It will be understood, however, that the elevator employed in the present embodiment is to be considered optional and that the invention may be utilized in a self-loaded bowl, without any elevator, if desired.

In accordance with the present invention horizontal guide tracks are provided inside the respective side sheets and having a rolling frame mounted between them for normally closing the space between the fixed floor section and the blade base. A flexible load-supporting floor structure extends forwardly over the roller frame and around the nose portion thereof, with the leading end of the floor structure extending into return space below the rolling frame. In the preferred form of the invention an ejector plate is mounted at the rear end of the flexible floor structure. An actuator coupled to the leading end of the flexible floor structure draws it rearwardly within the return space to produce rearward movement of the frame to create a discharge opening at the bottom of the bowl. Upon continued movement the floor structure and its ejector plate transport to the opening the soil collected at the rear of the bowl. When the bowl is empty an actuator coupled to the rolling frame returns the same forwardly to close the opening while the flexible floor structure is restored to normal position.

Figure 5:
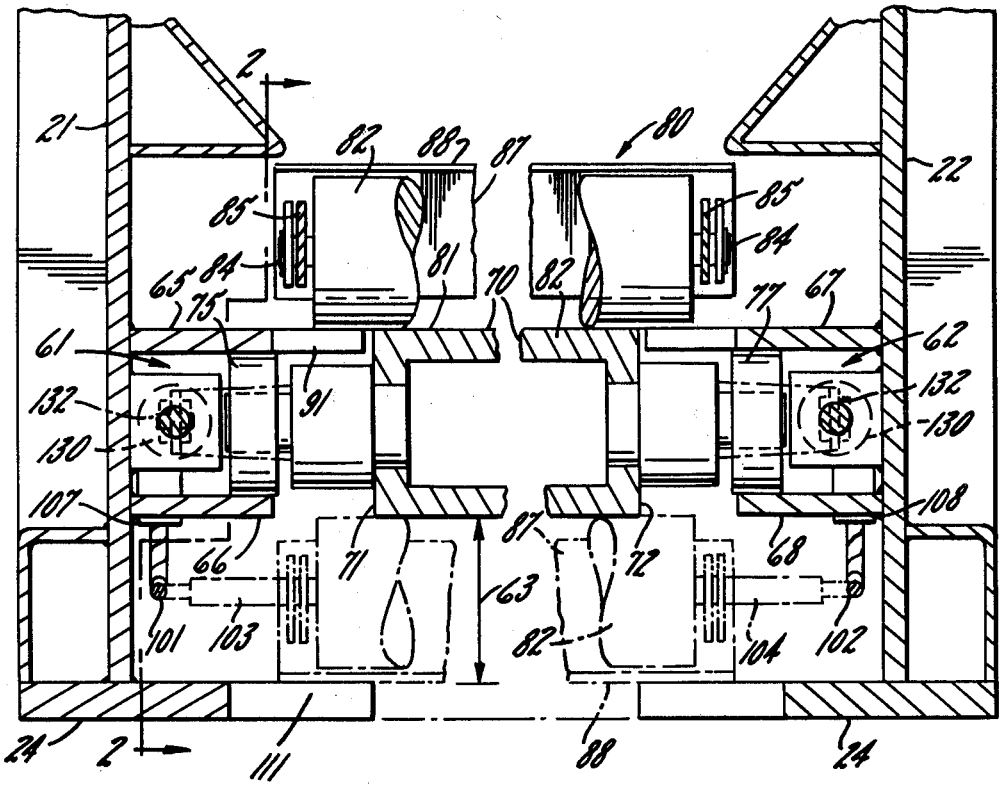
FIG. 5 is a fragmentary section taken along the line 5—5 in FIG. 2.

Thus, referring to the drawings (see especially FIG. 5), a pair of horizontal opposed guide tracks 61, 62 are provided on the inside surfaces of the side sheets 21, 22 and spaced sufficiently above the fixed floor 24 so as to provide a return space, or chute, 63 for the floor structure, as will be discussed in greater detail. The track 61, it will be seen, is formed of a pair of guide members 65, 66 which have a constant spacing with respect to one another. Corresponding guide members 67, 68 form track 62.

Mounted between the guide tracks 61, 62 is a rolling frame 70 (see FIG. 7) having side members 71, 72 spanned by a table 73. For supporting the rolling frame in the guide tracks, the side member 71 is provided with a pair of supporting rollers 75, 76 while the side member 72 has similar supporting rollers 77, 78. The rolling frame provides horizontal support surfaces 81, 82 merging with a rounded nose surface 83 at the front of the frame. The rolling frame 70, as shown in FIG. 2, occupies a normal position centered over the discharge opening between the fixed floor section 24 and the blade base 25.

In carrying out the invention the load of soil is carried upon a flexible floor structure which extends laterally from one side sheet to the other and from the rear of the bowl forwardly over the rolling frame, with the leading end extending around the nose portion of the rolling frame and into the return space 63 to form a loop. In the preferred embodiment the flexible floor section 80 (FIG. 2) includes a roller train comprised of a series of rollers extending transversely between the side sheets, the rollers being spaced side-by-side and supported upon the rolling frame, with adjacent rollers being connected to one another at the ends by links.

Figure 8:
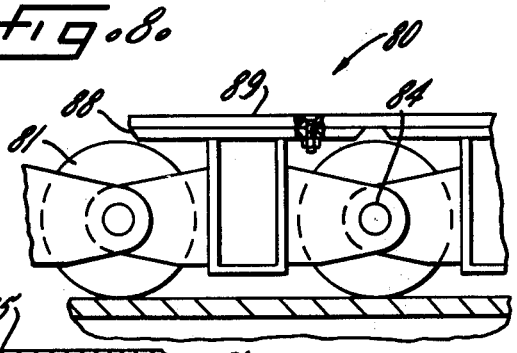
FIG. 8 is a view similar to FIG. 2*a* but with a rubber cover to prevent leakage.

Floor strips, extending full width between the side sheets, and closely spaced edge-to-edge, are supported upon successive links for articulation so that the floor structure is capable of undergoing a 180° turn about the nose portion of the rolling frame. In FIG. 2*a*, one section of that structure is shown including a pair of rollers 81, 82. The rollers have axles 83, 84 journalled in the ends of a pair of links 85. Extending longitudinally in the space between the adjacent rollers, from one link to the other, is a box beam 87 rigidly supporting a floor strip 88. If desired, the successive floor strips 88 may be bridged by a rubber cover sheet 89 (FIG. 8) to provide a more smoothly continuous supporting surface and to prevent leakage of soil through the gaps between the floor strips.

Figure 6:
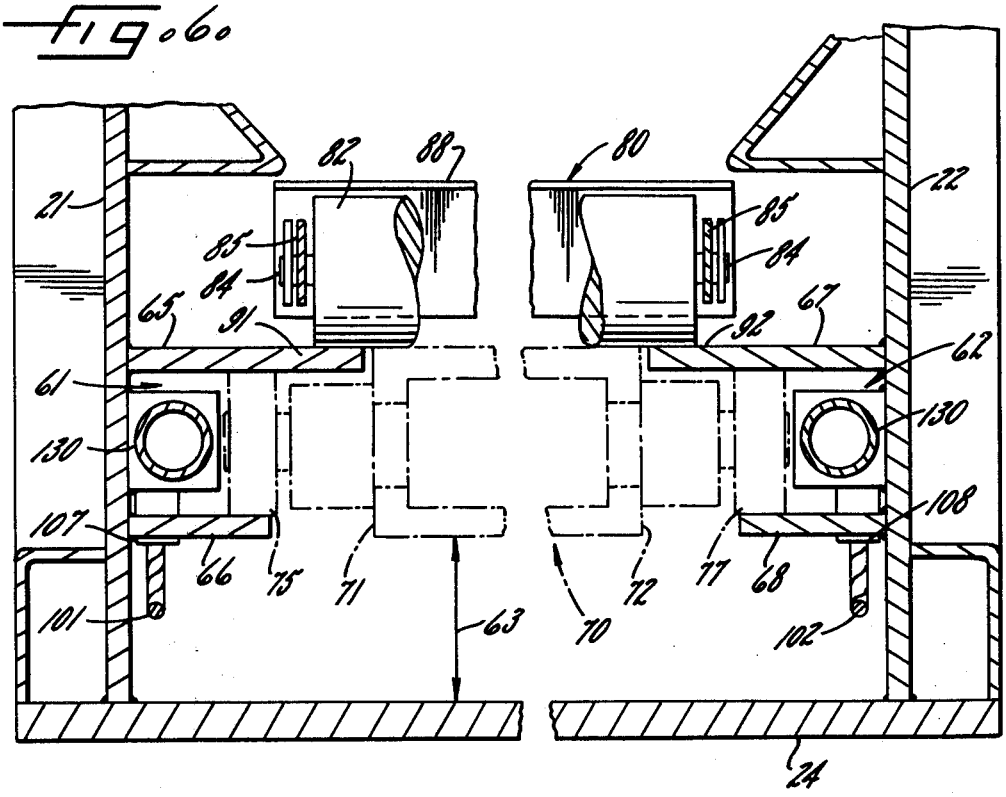
FIG. 6 is a fragmentary section taken along the ling 6—6.
Figure 7:
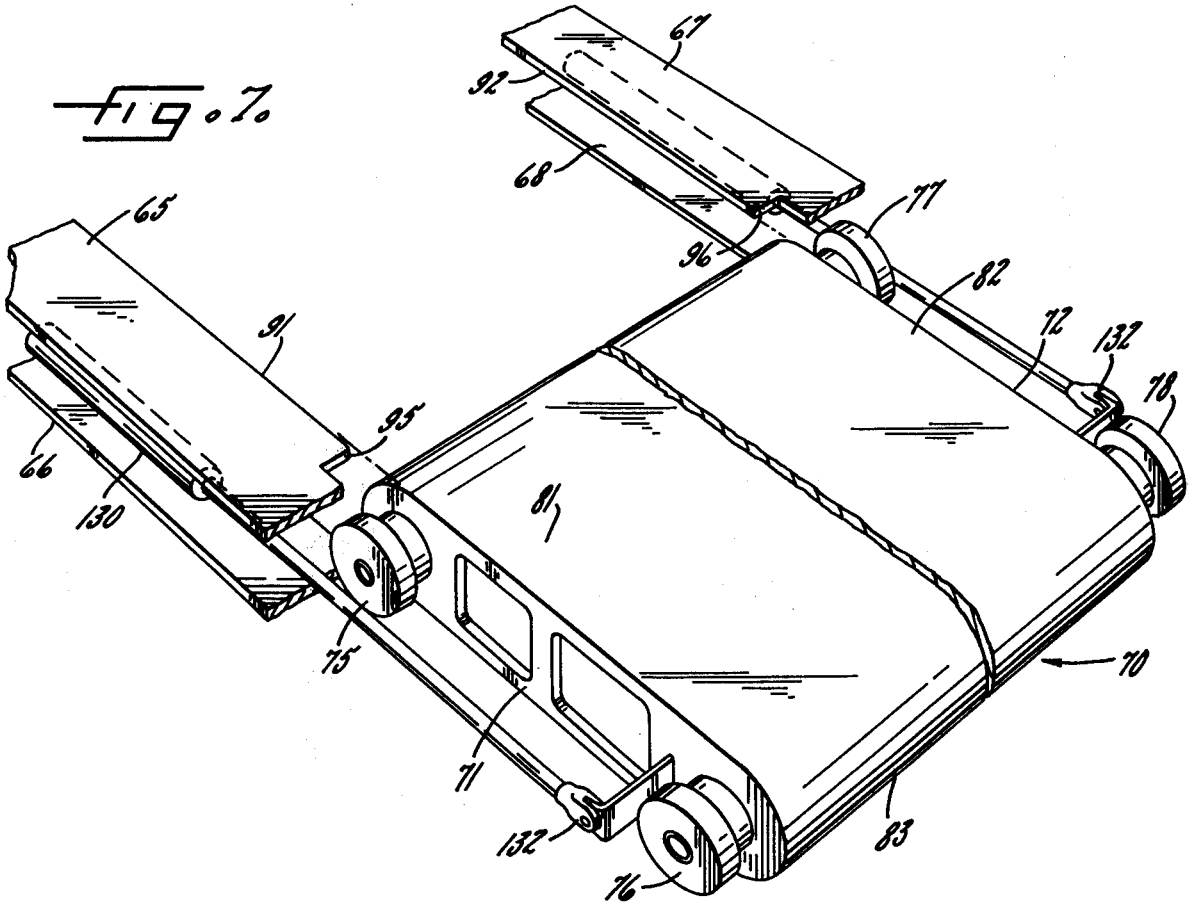
FIG. 7 is a fragmentary perspective view of the rolling frame shown in the above figures with its cooperating guide members.

While the flexible floor structure is supported on the rolling frame over the leading portion of the floor area, special provision is made for supporting the rollers of the floor structure in the region rearwardly of the rolling frame, as illustrated in FIGS. 6 and 7. Briefly stated, and in accordance with the invention, rear roller support structure is provided by extending the guide members 65, 67 inwardly over the rearward half of the scraper to form supporting ledges 91, 92 having leading ends 95, 96. The ledges are sufficiently wide to provide reliable support at the ends of the rollers, while the guide members 66, 68, which are in lower position, are spaced to "clear" the links 85 and the floor strips 88 supported thereon. This insures that the front portion of the flexible floor structure will be able to pass downwardly about the nose portion 83 of the rolling frame between the guide members at the same time that the rear portion is supported by the ledges 91, 92.

In carrying out the invention an actuator is provided for drawing the leading end of the flexible floor structure, indicated at 100, (see FIG. 2) into the return space 63, with the floor structure turning through an angle of 180° and into a storage position below the sliding frame 70. This is preferably done by means of cables 101, 102 which are respectively connected to the ends 103, 104 of the roller axles. The cables 101, 102 run along the sides of the return space 63, with the ends thereof wound about drums 105, 106. At the rear end of the bowl the cables are trained about sheaves 107, 108, at which point the cables proceed upwardly along a vertical continuation 63*a* of the return space 63, the return space being of dog-leg shape. The two drums 105, 106 are driven in unison by means of an hydraulic motor 109.

Figures 3, 4:
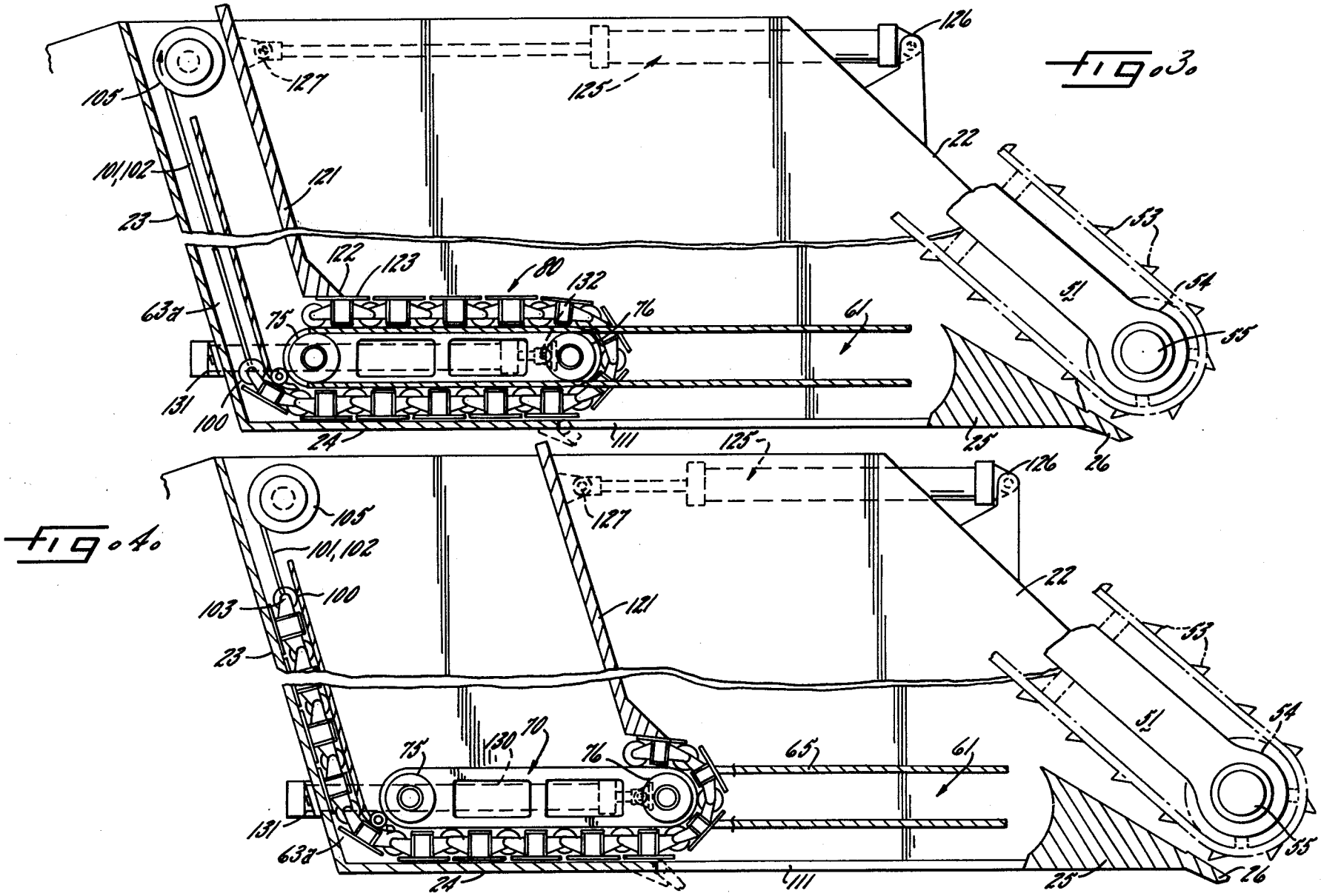
FIG. 3 is a view similar to FIG. 2 but showing creation of the discharge opening between the fixed floor section and the blade base.
FIG. 4 shows the result of subsequent movement of the roller train and ejector plate for transport of the soil from the back of the bowl for discharge through the opening.

The effect of the cables 101, 102 will be seen by comparing FIG. 2, which shows the normal condition of the floor, to FIG. 3. Tensioning the cables serves to draw the leading end 100 of the flexible floor around the rounded nose surface 83 of the rolling frame 70 and into the return space 63, causing the floor structure to loop progressively through 180°, with articulation between the roller axles and the links. Since the tail end of the floor structure temporarily remains in position, for reasons which will be explained, the effective shortening of the loop of floor structure causes the rolling frame to be crowded rearwardly from its normal closed position to its retracted open position illustrated in FIG. 3, thereby creating a discharge opening 110 for the soil which has been collected in the bowl, flanked by supporting ledges 111, 112. Rearward movement of the rolling frame 70 results in rearward rolling of the rollers 75–78 in the tracks 61, 62. When the frame is fully retracted the nose surface 73 of the rolling frame occupies a position above the front edge of the floor section 24. To achieve an opening of maximum size, the rolling frame preferably has a length, measured fore-and-aft, which is approximately half of the length of the bowl.

In accordance with one of the aspects of the present invention an ejector plate is secured to the trailing end of the flexible floor structure, an actuator being provided for thrusting the ejector plate forwardly for discharge and rearwardly for return of the plate and floor structure to normal position. Thus, as shown in FIG. 2 there is connected to the trailing end of the floor structure, indicated at 120, an ejector plate 121, the lower end of the ejector plate 122 being permanently secured to the terminal floor strip 123 as, for example, by welding. Auxiliary guidance of the ejector plate 121 may be provided by rollers on the plate engaging tracks or way surfaces formed on the inside surfaces of the side plates, a matter well within the skill of the art. For thrusting the ejector plate a double acting hydraulic actuator 125 is provided which is anchored at 126 to the bowl structure and which has a point of connection 127 to the ejector plate. The actuator 125 will normally consist of two actuator sections, one on each side of the bowl and connected in parallel.

With the bowl loaded with soil, the friction of the soil against the side plates will normally oppose forward thrusting movement of the ejector plate 121 sufficiently so that movement of the ejector plate will not begin to occur until the rolling frame 70 has moved to a fully retracted position creating the large discharge opening 111 as illustrated in FIG. 3. When this condition is reached pressure is built up in the actuator 125 in a direction to collapse the actuator, and the hydraulic motor 109 and actuator 125 subsequently act together to produce movement of the ejector plate 121 and the floor structure so that the ejector plate 121 moves into the position shown in FIG. 4, accompanied by movement of the floor structure into the vertical leg 63a of the return space. As a result, the soil which has collected in the rear portion of the bowl is shoved forwardly, falling through the discharge opening. A striker blade 24*a* with suitable actuator (not shown) may be provided, if desired, at the front edge of the fixed floor section 24 (FIG. 2) for leveling purposes.

It may be noted that the ejector plate 121 in the present construction, by reason of the flexible floor structure to which it is connected, operates differently from a conventional ejector. A conventional ejector not only must move the contained soil but it must, at the same time, overcome the frictional force and adhesion of the soil against the floor of the bowl by shearing action. Where the soil is wet and clayey, most of the force exerted by the ejector actuator must be used to overcome this frictional effect so that large actuators capable of delivering a powerful thrust have always been assumed to be necessary. In the present construction, by contrast, there is no necessity for the lower edge of the ejector blade to scrape the soil clear of the floor. On the contrary, the soil maintains its position relative to the floor strips, with the soil and the strips moving together toward the discharge opening. The only shearing action to be overcome is that which exists between the soil and the side sheets of the bowl, which is usually minor as compared to the frictional force at the bottom of the bowl. As a result the actuator 125 may be of relatively light construction.

A further improvement is brought about by the nature of the discharge at the opening 110. In conventional usage of an ejector blade the soil is pushed to a point above the discharge opening and reliance is placed upon the weight of the soil to secure prompt depositing. However in the case of clayey soils, the weight of the soil often cannot overcome the frictional forces holding the soil in the bowl and the soil thus becomes "hung up", refusing to discharge promptly and evenly. By contrast in the present construction, soil tends to cling to the floor strips which, as they round the nose at the front of the roller frame 70 impart a progressive downward pull upon the soil, the amount of such pull varying in accordance with the sticky nature of the soil, with the result that positive and even distribution of the soil occurs over a wider range of soil consistency.

After the load has been completely discharged, the rolling frame 70 is thrust forwardly, back into its closed position. This is accomplished by means of the actuator 130 which is connected at 131 to the bowl structure and which is connected at 132 to the front end of the rolling frame. The actuator 130 is preferably provided in tandem as illustrated in FIG. 7, and the two actuating sections are preferably nested in the roots of the tracks 61, 62 (see FIG. 5) to insure that a straight and balanced thrust is applied. When the actuator 130 is pressurized for extension the rolling frame 70 is thrust forwardly for progressive closing of the discharge opening. At the same time the actuator 125 is pressurized in the "extend" direction causing the ejector plate 121, and with it the trailing end 120 of the flexible floor structure, to be restored from the condition shown in FIG. 4 to the normal position illustrated in FIG. 2.

Figure 9:
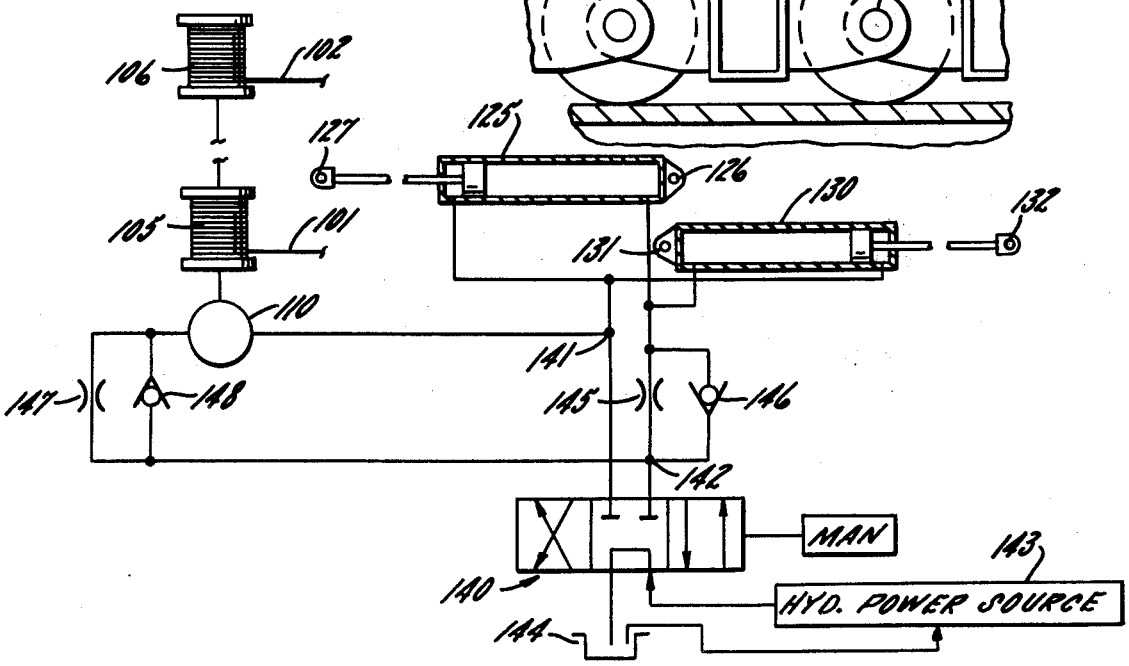
FIG. 9 is a schematic diagram showing hydraulic circuitry.

The hydraulic circuit for sequencing the floor structure and ejector plate with respect to the rolling frame is illustrated in FIG. 9. A four-way valve 140 is provided having output lines 141, 142, hydraulic fluid being fed to the valve from an hydraulic power source 143 and with provision for venting to a sump 144. In FIG. 9 the actuators 125, 130 which control the ejector plate and rolling frame are shown in their normal, fully extended, positions, with the ejector plate occupying its normal position at the back of the bowl and with the rolling frame in its enclosing position. When the valve 140 is in its illustrated central position the fluid is locked in place in the actuators during the scraping operation.

To empty the bowl the valve plunger is moved to the right, thereby pressurizing the first outlet connection 141 and connecting the second, 142, to the sump. Pressurized fluid at line 141 acts upon all three of the actuators. In the first place, fluid is applied to the rotary hydraulic motor 110 causing the sheaves 105, 106 to wind up the cables 101, 102 to pull the leading end 100 of the floor structure into the return, or storage, space 63 for support inverted on the ledges 111, 112. At the same time fluid is applied to the actuator 130 associated with the rolling frame to contract the actuator so that the rolling frame is retracted in step with the shortening of the "loop" of floor structure.

Also at the same time pressure at line 141 serves to contract the actuator 125 connected to the ejector plate so that the ejector plate tends to be drawn forwardly. However, since the ejector plate must overcome friction of the soil against the side plates, the actuator 125 resists movement as long as fluid from the power source 143 is being comsumed by the motor 109 and actuator 130. When the rolling frame 70 bottoms in its retracted position, illustrated in FIG. 3, the actuator 130 can move no further and the load upon the hydraulic motor 109 increases, developing back pressure which is applied to the actuator 125 so that the actuator 125 and motor 109 thereafter act in unison with one another to produce continued movement of the floor structure and forward thrusting movement of the ejector plate 121 at the tail end of the floor structure. The mechanism thus assumes the condition illustrated in FIG. 4, in which the soil is completely discharged from the bowl. Preferably a restriction, indicated at 145, is provided in the return line 142 so that the opening and discharger sequence outlined above occurs progressively so that the soil discharged through the opening 110 is discharged gradually on a distributed basis, rather than all at once.

To restore the bowl mechanism to the condition illustrated in FIG. 2, the valve plunger 140 is moved to the left pressurizing line 142. Under such conditions the restriction 145 is effectively taken out of the circuit by bypassing it with a check valve 146 which is faced to permit rapid fluid flow in a direction to extend both of the actuators 125, 130. Thus the ejector plate 121 is thrust toward the back of the bowl, accompanied by movement of the trailing end 120 of the floor structure, at the same time as the rolling frame 70 is thrust forwardly by the actuator 130. Since, upon closing, there is no soil resistance to be overcome, the parts are restored rather promptly to the positions illustrated in FIG. 2. To insure against development of slack in the cables 101, 102, on closing, the hydraulic motor 109, which is preferably of the positive displacement type, is provided with a restriction 147 in line 142. The restriction 147 is bypassed by a check valve 148 so that the restriction is effectively removed from the circuit during the "opening" sequence discussed earlier.

The present invention has been discussed in connection with the scraper equipped with an elevator 50 and has particular advantage when used with such an elevator. As is well known, one of the functions of an elevator is to insure loading all the way to the rear of the bowl, and is one of the advantages of the present invention that soil is discharged from the rear of the bowl promptly and efficiently. Nevertheless it will be understood that invention is applicable to all scraper bowls regardless of the presence of an elevator.

While the invention has been described in connection with flexible floor structure employing a roller train supporting floor strips arranged closely adjacent one another, it will be understood that the invention in its broader aspects is not limited to a floor formed of rigid articualted strips but includes the possibility of using a continuous flexible blanket of rubber or the like, reinforced with steel cables to provide a high degree of strength and having a leading end 100 to which tractive cables 101, 102 or the like are connected and having a trailing end 120 carrying an ejector plate 121. Where the floor 80 is in the form of a flexible blanket, suitable anti-friction means may be employed under the blanket as for example, a set of stationary rollers and the rounded nose surface 84 may be replaced by a transversely extending roller of the same radius. If a flexible blanket is used, such blanket should preferably be stiffened laterally by imbedding stiffening elements, extending at right angles to the direction of movement. It will be understood that since a continuous flexible blanket does not have the strength and rigidity of the preferred form of articulated floor structure, its use is reserved for scrapers of relatively small size.

It will be apparent that the objects of the invention have been amply carried out: A large discharge opening is produced having a dimension which is approximately half the length of the bowl. The soil which is collected in the rear half of the bowl is quickly and easily transported to the discharge opening by an ejector plate free of any shearing action of the ejector plate with respect to the bottom surface of the bowl. Not only is discharge more prompt and positive but it occurs at a more precisely controlled rate, even in the case of difficult soils. The discharge opening is created using only small operating forces, and the problems associated with conventional sliding floor sections, which must overcome shearing forces and which suffer from cocking and jamming, are completely overcome. The invention, in effect, interposes roller bearings between the soil and the bowl structure so that relative movement is, to large degree, unopposed. The result is a more rapid unloading cycle and therefore more efficient utilization of the scraper, the reduced operating forces bringing about a reduction of maintenance problems as well as conserving energy.

Figure 10:
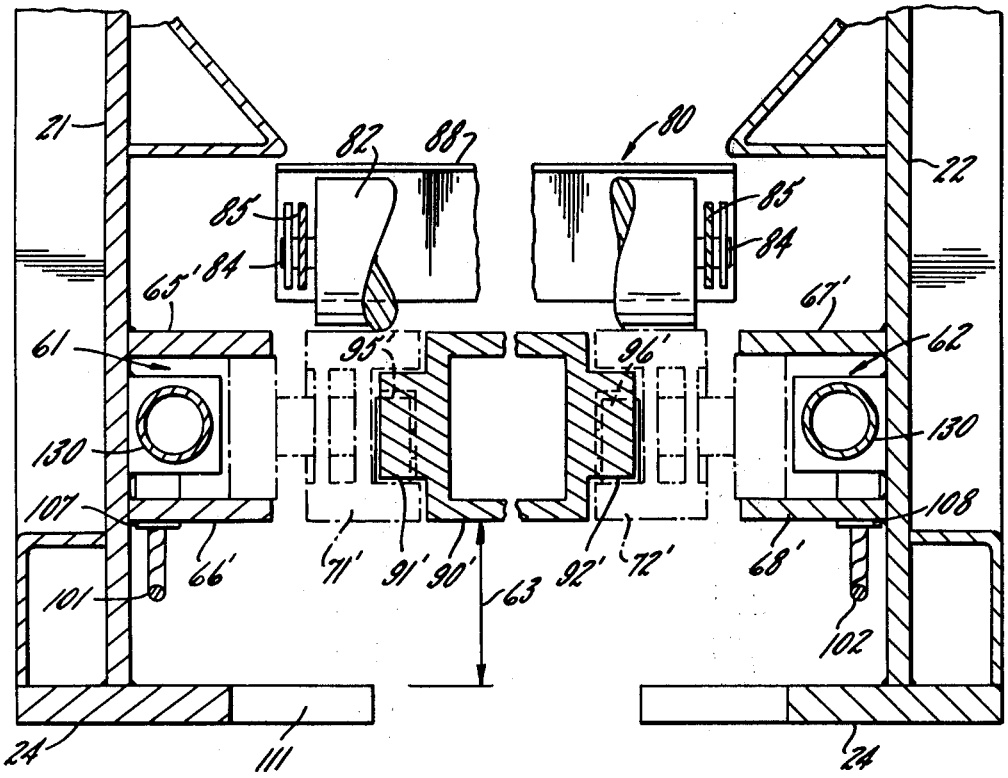
FIG. 10 is similar to FIG. 6, showing an alternate construction.
Figure 11:
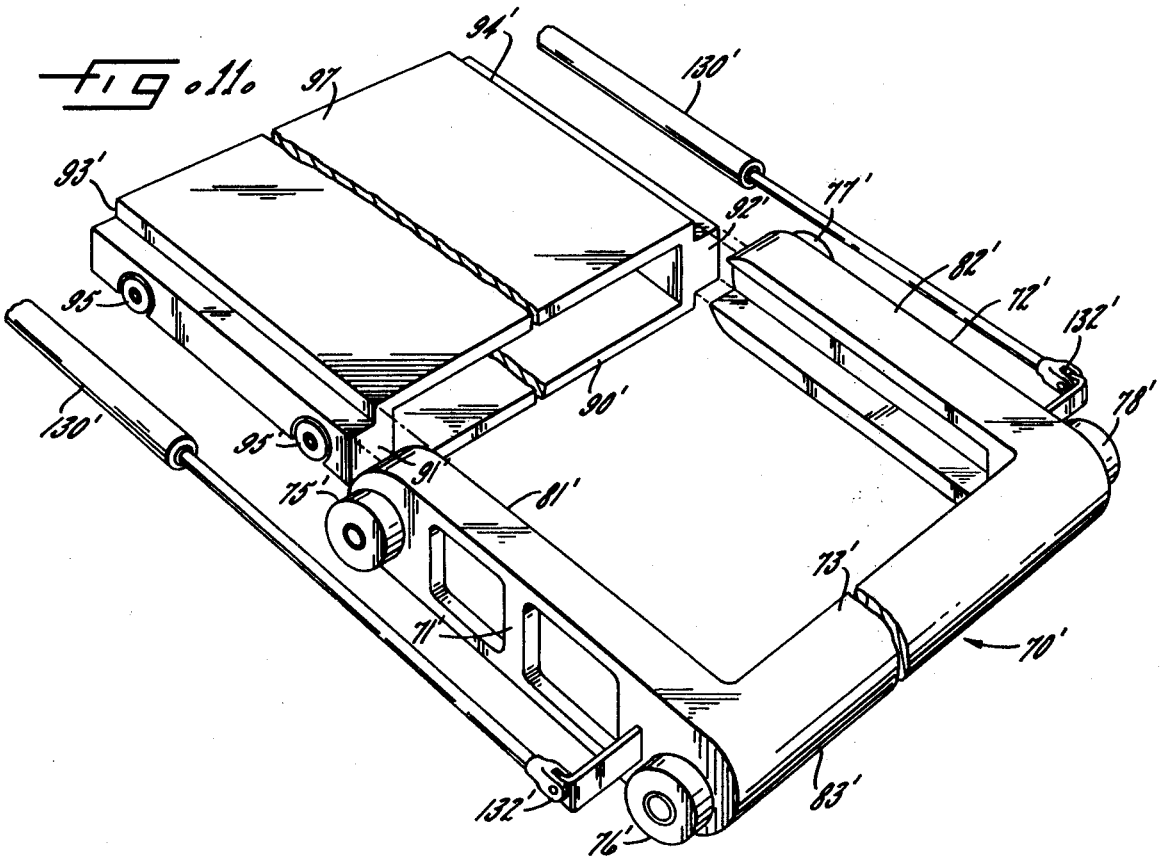
FIG. 11 further illustrates the alternate construction.

In the preferred embodiment (see FIG. 7) the ends of the transversely extending rollers are supported upon the ledges 91, 92. If desired, more continuous support may be provided for such rollers by utilizing a table-like rear supporting member which is anchored at its rear end and which is in telescoping relation to the rolling frame 70. Turning to FIGS. 10 and 11, in which similar elements are denoted by similar primed reference numerals, a rear support member 90′ is used having lateral edges 91′, 92′, the member being supported at its rear end with respect to the bowl at 93′, 94′ and at its front end by rollers 95′. For telescoping accommodation of the supporting member 90′ the rolling frame 70′ is of "hollow" construction formed of side members 71′, 72′ and a front cross member 73′, the side members defining support surfaces 81′, 82′ leading to a curved nose surface 83′. The operation is the same as in the preferred embodiment previously described.

What is claimed is:

1. A scraper for earth moving purposes, the combination comprising an open-fronted bowl structure formed of a pair of laterally spaced vertical side sheets, defining a bowl a blade base having a blade at the front edge of the bowl, a tractor supported draft frame, positioning means for supporting the bowl with respect to the draft frame so that the blade cuuts into the ground at a predetermined level, a horizontally shiftable frame normally occupying the space rearwardly of the blade base, means for supporting the shiftable frame for movement rearwardly from the normal position, flexible floor structure for supporting the load of soil and extending in its normal position from a trailing end at the rear of the bowl forwardly over the shiftable frame and downwardly about the front end of the frame through an angle of substantially 180° to form a loop having a leading end, said flexible floor structure being movable and having anti-friction means on its underside, an ejector plate secured to the trailing end of the floor structure and extending substantially vertically between the side sheets at the back of the bowl, actuator means for pulling the leading end of the floor structure rearwardly to shorten the loop accompanied by shifting of the frame to open up a discharge opening to the rear of the blade base and followed by forward movement of the ejector plate for discharge of the contained soil through the opening.

2. The combination as claimed in claim 1 in which the anti-friction means is in the form of a series of transversely extending rollers.

3. The combination as claimed in claim 1 in which the shiftable frame has a horizontal supporting surface end in which a support having a horizontal surface flush therewith is provided for supporting the floor structure rearwardly of the shiftable frame in all positions of the latter.

4. In a scraper for earth moving purposes, the combination comprising an open-fronted bowl structure formed of a pair of laterally spaced vertical side sheets, defining a bowl a fixed floor section bridging the side sheets at the rear portion of the latter, a blade base having a blade and bridging the side sheets at the front edge thereof to define a discharge opening, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame on the guide tracks for movement from the normal position to a position above the fixed floor section, flexible floor structure for supporting the load of soil and extending in its normal position from a trailing end at the rear of the bowl forwardly over the roller frame with the leading end of the flexible floor structure being wrapped around the rounded nose of the rolling frame and extending into the return space below the rolling frame, an ejector plate secured to the trailing end of the flexible floor structure and extending substantially vertically between the side sheets at the back of the bowl, and actuator means for reciprocating the floor structure and rolling frame from their normal positions to respectively shifted positions for discharge of the soil through the opening.

5. In a scraper for earth moving purposes, the combination comprising an open-fronted bowl structure formed of a pair of laterally spaced vertical side sheets, defining a bowl a fixed floor section bridging the side sheets at the rear portion of the latter, a blade base having a blade and bridging the side sheets at the front edge thereof, to define a discharge opening, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame on the guide tracks for movement from the normal position to a position above the fixed floor section, flexible floor structure for supporting the load of soil and extending in its normal position from a trailing end at the rear of the bowl forwardly over the roller frame with the leading end of the flexible floor structure being wrapped around the rounded nose of the rolling frame and extending into the return space below the rolling frame, an ejector plate secured to the trailing end of the flexible floor structure and extending substantially vertically between the side sheets at the back of the bowl, a series of anti-friction rollers interposed between the flexible floor structure and the rolling frame and extending transversely between the side sheets, and actuator means for reciprocating the floor structure and rolling frame from their normal positions to respectively shifted positions for discharge of the soil through the opening.

6. In a scraper for earth moving purposes, the combination commprising an open-fronted bowl structure formed of a pair of laterally spaced vertical side sheets, defining a bowl a fixed floor section bridging the side sheets at the rear portion of the latter, a blade base having a blade and bridging the side sheets at the front edge thereof, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame on the guide tracks for movement from the normal position to a retracted position above the fixed floor section, flexible floor structure for supporting the load of soil and extending from a trailing end at the rear of the bowl forwardly over the roller frame with the leading end of the flexible floor structure being wrapped around the rounded nose of the rolling frame and projecting into the return space below the rolling frame, an ejector plate secured to the trailing end of the flexible floor structure and extending substantially vertically between the side sheets at the back of the bowl, first horiizontal actuator means connected to the leading end of the flexible floor structure, second horizontal actuator means connected to the rolling frame, and third horizontal actuator means connected to the ejector plate, means for energizing the first actuator means to pull the leading end of the flexible floor structure rearwardly within the return space accompanined by rearward retraction of the rolling frame to open up a large discharge opening for the contained soil between the blade base and the fixed floor section and for simultaneously energizing the first and third actuator means for continued movement of the flexible floor structure and ejector plate for ejecting through the discharge opening the soil contained at the back of the bowl, and means for energizing the second actuator means and for reversely energizing the third actuator means to push the rolling frame forwardly back into its normal position for closing the discharge opening and for pushing the ejector plate rearwardly back into its normal position at the back of the bowl accompanied by retraction of the flexible floor structure from the return space.

7. In a scraper for earth moving purposes, the combination comprising an open-fronted bowl structure formed of a pair of laterally spaced vertical side sheets, difining a bowl a fixed floor section bridging the side sheets at the rear portion of the latter, a blade base having a blade and bridging the siide sheets at the front edge thereof to define a discharge opening, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame on the guide tracks for movement from the normal position to a retracted position above the fixed floor section, flexible floor structure for supporting the load of soil and extending in its normal position from a trailing end at the rear of the bowl forwardly over the rolling frame with the leading end of the flexible floor structure being wrapped around the rounded nose of the rolling frame and projecting into the return space below the rolling frame, an ejector plate secured to the trailing end of the flexible floor structure and extending substantially vertically between the side sheets at the back of the bowl, first horizontal actuator means connected to the leading end of the flexible floor structure, second horizontal actuator means connected to the rolling frame, and third horizontal actuator means connected to the ejector plate, means for energizing the first actuator means to pull the leading end of the flexible floor structure rearwardly with the return space accompanied by rearward retraction of the rolling frame to open up a large discharge opening for the contained soil between the blade base and the fixed floor section and for thereafter energizing the third actuator means for forward movement of the flexible floor structure and ejector plate for ejecting through the discharge opening the soil contained at the back of the bowl.

8. The combination as claimed in claim 7 in which the actuators are hydraulic and have means for throttling the hydraulic fluid supplied thereto for sequential movement of the rolling frame and ejector plate at a controlled rate of speed for progressing discharge of the contained soil.

9. In a scraper for earth moving purposes, the combination comprising an open-fronted bowl structure formed of a pair of laterally spaced vertical side sheets, defining a bowl a fixed floor section bridging the side sheets at the rear portion of the latter, a blade base having a blade and bridging the side sheets at the front edge thereof to define a discharge opening, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame on the guide tracks for movement from the normal position to a position above the fixed floor section, flexible floor structure for supporting the load of soil and extending in its normal position from a trailing end at the rear of the bowl forwardly over the roller frame with the leading end of the flexible floor structure being wrapped around the rounded nose of the rolling frame and projecting into the return space below the rolling frame, an ejector plate secured to the trailing end of the flexible floor structure and extending substantially vertically between the side sheets at the back of the bowl, actuator means for moving the floor structure and rolling frame from their normal positions to respectively shifted positions, the floor structure being in the form of a roller train supporting a series of rigid articulated floor strips extending between the side sheets.

10. In a scraper for earth moving purposes, the combination comprising an open-fronted bowl structure formed of a pair of laterally spaced vertical side sheets, defining a bowl a fixed floor section bridging the side sheets at the rear portion of the latter, a blade base having a blade and bridging the side sheets at the front edge thereof to define a discharge opening, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, upper and lower guide members on the side sheets laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame in the guide trakcs for movement from the normal position to a position above the fixed floor section, flexible floor structure for supportiing the load of soil and extending in its normal position from a trailing end at the rear of the bowl forwardly over the roller frame with the leading end of the flexible floor structure being wrapped around the rounded nose of the rolling frame and extending into the return space below the rolling frame, the flexible floor structure including a roller train, the upper guide members being inwardly extended over approximately the rear half of the bowl to provide supporting ledges which are flush with the top surface of the rolling frame for supporting the ends of the rollers which are to the rear of the rolling frame in all positions thereof, an ejector plate secured to the trailing end of the flexible floor structure and extending substantially vertically between the side sheets at the back of the bowl, and actuator means for reciprocating the floor structure and rolling frame from their normal positions to respectively shifted positions for discharge of the soil through the opening.

11. In a scraper for earth moving purposes, the combination comprising an open-fronted bowl structure formed of a pair of laterally spaced vertical side sheets, defining a bowl a fixed floor section bridging the side sheets at the rear portion thereof, a blade base having a blade and bridging the side sheets at the front edge thereof, a tractor-supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space, a rolling frame extending between the guide tracks normally occupying the space between the blade base and the fixed floor section and having a rounded nose portion adjacent the blade base, means for supporting the rolling frame in the guide tracks for movement from the normal position to a retracted position above the fixed floor section, flexible floor structure extending laterally to bridge the space between the side sheets and extending forwardly over the roller frame and around the nose portion thereof with the leading end in the return space, anti-friction means between the flexible floor structure and the top surface of the rolling frame, first horizontal actuator means connected between the bowl structure and the leading end of the flexible floor structure, second horizontal actuator means connected between the bowl structure and the rolling frame, means for energizing the first actuator means to pull the leading end of the flexible floor structure rearwardly within the return space accompanied by rearward retractionn of the rolling frame to open up a large discharge opening for the soil between the blade base and the fixed floor section, and means for energizing the second actuator means to push the rolling frame forwardly back into its normal position accompanied by retraction of the leading end of the flexible floor structure for reclosing the discharge opening.

12. In a scraper for earth moving purposes, the combination comprising an open-fronted bowl structure formed of a pair of alterally spaced vertical side sheets, defining a bowl a fixed floor section bridging the side sheets at the rear portion of the latter, a blade base having a blade and bridging the side sheets at the front edge thereof to define a discharge opening, a tractor supported draft frame, a pair of draft members pivotally secured at their rear ends to the side sheets and extending forwardly for rigid connection at their front ends to the draft frame, bowl positioning means for supporting the bowl with respect to the draft frame so that the blade cuts into the ground at a predetermined level, means on the side sheets forming laterally opposed horizontal guide tracks spaced above the fixed floor section to define a return space of dog-leg shape having a horizontal position and a vertical position, a rolling frame extending between the guide tracks normally occupying the space between the blade base and the fixed floor section and having a rounded nose portion adjacent the blade base, means for supporting the rolling frame in the guide tracks for movement from the normal position to a position above the fixed floor section, flexible floor structure for supporting the load of soil extending in its normal position from a trailing end at the rear of the bowl forwardly over the roller frame with the leading end of the flexible floor structure being wrapped around the rounded nose of the rolling frame and extending into the horizontal portion return space below the rolling frame, an ejector plate secured to the trailing end of the flexible floor structure and extending substantially vertically between the side sheets at the back of the bowl, and actuator means including cables for drawing the leading end of the floor structure into the vertical portion of the return space accompanied by shifting of the rolling frame to open position and forward thrusting of the ejector plate for discharge of the contained soil.

13. In a scraper for earth moving purposes, the combination comprising an open-fronted bowl structure formed of a pair of spaced vertical side sheets, defiining a bowl a fixed floor section bridging the side sheets at the rear portion thereof, a blade base having a blade and bridging the side sheets at the front edge thereof, a tractor-supported draft frame, a pair of draft members pivotally secured at the rear ends to the side sheets and extending forwardly for rigid connection at their front ends to the draft frame, means for supporting the bowl with respect to the draft frame so that the blade cuts into the ground at a predetermined level, guide tracks extending horizontally along the inside surfaces of each of the side sheets at a level above the fixed floor section to define a return space, a rolling frame between the guide tracks and normally occupying the space ahead of the fixed floor section, means on the rolling frame coupled to the guide tracks for movement of the frame fore-and-aft within the bowl, a roller train comprises of a series of rollers spaced side-by-side supported upon the rolling frame and extending transversely between the side sheets, adjacent ones of the rollers being connected to one another at the ends by links, floor strips supported on the links and extending full width between the side sheets, the strips being substantially edge-to-edge to form a flexible and substantially continuous floor surface extending forwardly to the blade base and overlying the rolling frame for supporting a load of soil lossened by the blade, the leading end of the roller train projecting downwardly about the front edge of the rolling frame into the return space, first horizontal actuator means connected to the leading end of the roller train, second horizontal actuator means connected to the rolling frame, and means for (a) energizing the first actuator means to pull the leading end of the roller train into the return space accompanied by rearward retraction of the rolling frame to open up a discharge opening for the soil rearwardly of the blade base and forwardly of the fixed floor section and for (b) energizing the second actuator means to push the rolling frame back into normal positon for closing the discharge opening.

14. In a scraper for earth moving purposes, the combination comprising an open-fronted bowl structure formed of a pair of spaced vertical side sheets, defining a bowl a fixed floor section bridging the side sheets at the rear portion thereof, a blade base having a blade and bridging the side sheets at the front edge thereof to define a discharge opening, the tractor-supported draft frame, a pair of draft members pivotally secured at the rear ends to the side sheets and extending forwardly for rigid connection at their front ends to the draft frame, bowl actuator means coupled to the front end of the bowl for supporting it at a predtermined level with respect to the draft frame so that the blade cuts into the ground, means on the side sheets forming laterally opposed horizontal guide tracks spaced above the fixed floor section to define a return space, rolling frame extending between the guide tracks and normally occupying the space ahead of the fixed floor section to close the discharge opening, means seucred to the sides of the rolling frame and extending laterally outwardly therefrom into the tracks for rolling support of the frame for-and-aft within the bowl, a roller train comprised of a series of rollers spaced side-by-side supported upon the rolling frame and extending transversely between the side sheets, adjacent ones of the rollers being connected to one another at the ends by links, floor strips supported upon the links and extending full width between the side sheets, the strips being substantially edge-to-edge to form a flexible substantially continuous floor surface extending forwardly to the blade base and overlying the rolling frame for supporting a load of soil lossened by the blade, the leading end of the roller train being wrapped downwardly about the front edge of the rolling frame into the return space, an ejector plate secured to the trailing end of the roller frame and extending substantially vertically between the side sheets at the back of the bowl, first horizontal actuator means connected to the leading end of the roller train, second horizontal actuator means connected to the rolling frame and third horizontal actuator means connected to the ejector plate, means for (a) energizing the first and third actuator means to pull the roller train into the return space accompanied by rearward retraction of the rolling frame and forward movement of the ejector plate for discharge of the collected soil between the blade base and the fixed floor section and for (b) energizing the second actuator means and energizing the third actuator means in the opposite direction to push the rolling frame back into normal position for closing the discharge opening and for simultaneously returning the ejector plate to the rear of the bowl.

15. In a scraper for earth moving purposes, the combination comprising an open-fronted bowl structure formed of a pair of laterally spaced vertical side sheets, defining a bowl a blade base having a blade at the front edge of the bowl, a tractor supported draft frame, positioning means for supporting the bowl with respect to the draft frame so that the blade cuts into the ground at a predetermined level, a frame extending bridgingly between the side sheets rearwardly of the blade base and having a rounded nose portion, a flexible floor structure for supporting the load of the soil and extending in its normal position from a trailing end at the rear of the bowl forwardly over the frame and downwardly about the front end of the frame through an angle of substantially 180° to form a loop having a leading end, said floor structure being shiftable fore annd aft and having antifriction means on its underside, an ejector plate secured to the trailing end of the floor structure and extending substantially vertically between the side sheets at the back of the bowl, means for creating a discharge opening to the rear of the blade base, and means for forcibly shifting the floor structure and ejector plate forwardly for ejection of the soil through the discharge opening.

16. In a scraper for earthmoving purposes, the combination comprising an open-fronted bowl structure formed of a pair of laterally spaced vertical side sheets, defining a bowl a blade base having a blade at the front edge of the bowl, a tractor supported draft frame, positioning means for supporting the bowl with respect to the draft frame so that the blade cuts into the ground at a predetermined level, a floor supporting member extending bridgingly between the side sheets rearwardly of the blade base and having a rounded nose portion, a flexible floor structure on the supporting member extending downwardly about the front end of the supporting member through an angle of substantially 180° to form a loop having a leading end, said flexible floor structure being formed of a series of transversely extending strips arranged substantially edge to edge, the strips being supported upon articualted links journalling a plurality of rollers forming an articulated roller train, means for creating a discharge opening to the rear of the blade base, and means for applying tractive force to the leading end of the floor structure so that the front portion of the floor structure moves rearwardly and the rear portion of the floor structure moves forwardly for ejection of the soil supported thereon through the discharge opening.

17. The combination as claimed in claim 16 including ledges secured to the side sheets at the lateral edges of the discharge opening for supporting and guiding the leading end of the floor structure and the successive strips thereof in inverted position under the floor supporting member.

* * * * *